United States Patent [19]

Santoro et al.

[11] 4,350,508

[45] Sep. 21, 1982

[54] DESICCANT CAP

[76] Inventors: Dario S. Santoro; Garry Schultz; Henry Miano, all of 231 Mt. Pleasant, Hauppauge, N.Y. 11788

[21] Appl. No.: 332,556

[22] Filed: Dec. 21, 1981

[51] Int. Cl.[3] ..... B01D 19/00

[52] U.S. Cl. ..... 55/275; 215/228; 55/387

[58] Field of Search ..... 55/275, 316, 527, 274, 55/528, 387; 220/371; 215/228, 227, 296, 302, 365

[56] References Cited

U.S. PATENT DOCUMENTS 3,422,679 1/1969 McGowan et al. ..... 55/385 R
4,146,277 3/1979 Santoro et al. ..... 215/227

FOREIGN PATENT DOCUMENTS 2343657 10/1977 France ..... 215/228
1206040 9/1970 United Kingdom ..... 215/227

*Primary Examiner*—Bernard Nozick

*Attorney, Agent, or Firm*—Kevin Redmond

[57] ABSTRACT

A transparent enclosure having an internal cavity divided into two portions, the first of which is designed to accept and hermetically seal a container. The second is designed to accept and hold a mixture of a desiccant and a humidity sensitive color indicator. The first and second portions of the cavity are separated by a barrier wall which contains a filter in the central area of the wall. The filter comprises a porous area in the barrier wall and is formed of a wicking polymer that conducts the humidity within the container to the desiccant and humidity sensitive color indicator, drying the contents of the container and causing the color indicator to provide a visual indication of the humidity within the container. The peripheral surface of the barrier wall is designed to engage and seal the barrier wall within the cavity in order to physically isolate the contents of the container from the desiccant, while providing a means by which the moisture within the container may be extracted by the desiccant.

5 Claims, 10 Drawing Figures

DESICCANT CAP

BACKGROUND

1. Field

The present invention pertains to means for dehumidification of containers and, more particularly, to container caps incorporating desiccant materials.

2. Prior Art

There are many and varied applications for desiccant caps intended to provide a low humidity atmosphere within an associated container. Materials requiring such protection include pharmaceuticals, seeds, food and machinery. The need for a reliable cap can be exemplified by the effect of moisture on special seeds, such as ornamental cactus seed. A relatively small bottle of these seeds may cost as much as $500. A short period of exposure to a moist atmosphere results in the sprouting and eventual destruction of the seeds. Damage is similarly incurred with many expensive pharmaceuticals when exposed to a humid atmosphere for a relatively short period of time.

A number of desiccant caps, bags and cartridges have been designed to overcome these problems as indicated by U.S. Pat. Nos. 1,425,790, 1,637,656, 1,655,248, 2,317,882, 2,446,361, 2,487,620, 2548,168 2,676,078, 3,820,309 and 3,990,872. The cap devices usually include a preforated metal holder for a desiccant which is either held together by a binder, such as asbestos, or separated from the container by a fibreglass sheet. In some cases the fibreglass is eliminated and only the preforated shield is used to isolate the desiccant from the container contents.

The results of these approaches has been inadequate. The dehumidification is short lived and the desiccant and carcenogenic materials, such as asbestos and fibreglass comingle with the container contents. The contents are often food and pharmaceuticals, making the use of such devices a serious health and product liability problem.

Attempts to avoid the use of desiccant caps by way of hermetically sealed caps embodying no desiccant have been found to be unsatisfactory. Such caps rarely provide a true hermetic seal. Even where a hermetic seal is achieved initially, the cap backs off over a period of time due to expansions and contractions of the cap caused by normal variations in ambient temperature.

In a number of prior art devices which use desiccants, an indication of the state of the desiccant cannot be determined by visual inspection, or if visual inspection is possible, the cap must be removed to make the inspection, resulting in detrimental exposure of the contents to moisture.

Some of the more sophistocated and expensive reusable caps do have humidity indicators which may be observed without opening the container, but they generally require that each individual container be picked up in order to observe the condition of the desiccant through the top of the cap, making it impractical to carry out a rapid determination of the state of humidity during shelf life.

Important disadvantages of prior art desiccator caps include high cost and the inability to have the state of the humidity rapidly determined while in storage. The inability to inspect rapidly generally increases the cost of storage, and where the cap must be opened for inspection, the storage life of the contents is appreciably shortened. The high cost of prior art devices is primarily due to the many machining operations required to produce the caps. In some cases, the expense is justified where the caps are intended for reuse. However, reuse is not practical for pharmaceuticals because of the possibility of contamination.

A prior art, low cost substitute designed to overcome the cost problem is the desiccant bar or cartridge which is simply inserted in the container along with the pharmaceuticals. Unfortunately, the bag or cartridge provide no indication of the humidity within the container and the humidity reducing capacity of such devices is limited. Where large bags or cartridges are used to extend useful life, they reduce the holding capacity of the container in proportion to their size. In addition, near sighted people have swollowed the pill sized desiccants, mistaking them for medication contained in similar sized capsules. As reported in the May 1980 issue of the Journal of the American Medical Association desiccants that are mistaken for capsules containing medication and are swollowed, result in gastrointestinal obstructions, requiring surgical removal in a number of cases.

SUMMARY

It is an object of the present invention to provide a cap containing a desiccant and an indicator of moisture content which may be viewed while in shelf storage to provide a rapid determination of the state of humidity within an associated container without the need to individually remove each container for inspection.

It is an object of the present invention to provide a desiccant containing cap which aids in the extraction of moisture from a container by incorperating a filter between the desiccant and the contents of the container that is fabricated from a wicking polymer.

It is an object of the present invention to speed production, reduce component cost as well as overall cost of a desiccant cap, by incorperating a self gasketing filter.

It is an object of the present invention to provide a low cost desiccator cap that permits disposal after use to avoid contamination of pharmaceuticals.

The present invention comprises a substantially nonporous, transparent plastic enclosure having a cavity divided into two portions. The first portion is designed to accept and hermetically seal a container, while the second portion is designed to accept and hold a mixture of a desiccant and a humidity sensitive indicator. The two portions are separated by a barrier wall containing a porous filter fabricated from a wicking polymer. The filter passes moisture within the container to the desiccant for absorption, but isolates the desiccant and color indicator from the container contents.

DETAILED DESCRIPTION OF THE INVENTION

Figure 1:
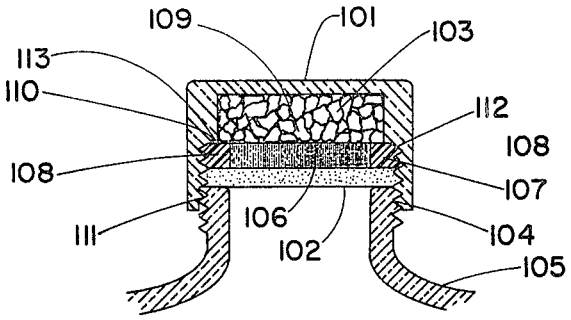
FIG. 1 is a cross sectional, side elevation view of a first embodiment of the invention illustrating the position of the filter and barrier wall which separates the color indicator and desiccant from the contents of the container.

Referring to FIG. 1, the present invention is shown to comprise a transparent, nonporous cap enclosure 101, with a closed ended generally cylindrical cavity 109, formed about a reference axis of revolution of the cap enclosure. A mixture of a humidity sensitive color indicator and a desiccant 103, (typically silica gel) are positioned adjacent the closed end of the cavity. The mixture of the desiccant and color indicator are separated from the contents of an associated container, such as container 105, by means of a disc shaped barrier wall and filter 102, which extends across the opening of the cavity 109. The cap is typically attached to the container by securing means, such as internal threads 104 which extend from the open end a portion of the distance towards the closed end.

The barrier wall is connected about its periphery to a bearing surface 110 on a shoulder 113 located on the inner walls of the cavity to completely seal the desiccant and indicator in the cavity. The bearing surface is positioned generally orthogonal to the axis of revolution of the cavity. The centrally located filter area 106 contains a number of fine pores which will not pass the humidity indicator or the contents of the container, preventing comingling of the container contents with the desiccant; however, the moisture content within the atmosphere in the container may pass through the filter pores in the barrier wall to the desiccant, where it is absorbed, maintaining the container at low humidity.

The color indicator is also exposed to the moisture content within the container by way of the filter pores and by virtue of its contact with the desiccant. Since the entire cap enclosure is transparent, the color indicator can be seen through various portions of the cap, including the sides and top. In view of this feature, the state of humidity within the container can be ascertained visually at a distance, eliminating the need to pick up each individual container, or open the container, as was required by the prior art. This feature is especially advantageous when used with products placed in inventory by means of shelf storage, a primary inventory system for pharmaceuticals. Although the containers may be stored several units deep on a shelf, the state of humidity may be ascertained for all the units on the shelf at a glance because of the relatively large area of the cap and the ability to see the color indicator from a wide range of aspect angles.

Figure 2:
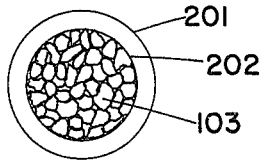
FIG. 2 is a top view of the cap showing the position of the desiccant and the color indicator within the cap.

The cap is preferably fabricated from a transparent, nonporous plastic which is either suitable for injection or thermocompression molding. FIG. 2 is a top view of a cap 201 showing the desiccant and color indicator 103 through the transparent top of the cap. The desiccant and color indicator 103 can be seen to be bounded by the inner contour 202 of the cap side wall. Formation of the cap enclosure to provide the features shown in FIG. 2 by these methods of manufacturing reduce the cost over prior art machining processes by a factor of ten or more. The barrier wall in a preferred embodiment is fabricated from a wicking polymer which not only passes a humid atmosphere through pores, but also aids the process by means of its wicking property which aids in drawing the moisture through the pores.

The plastic barrier wall is flexible and deforms slightly to accept and fill the imperfections on the lip of the container mouth, providing a hermetic seal without the use of O-rings; however, a plastic O-ring may be added to further improve the sealing process as desired.

The ability of the barrier wall to function as its own gasket is an important advantage in high volume production because the time required for insertion as well as the added cost of an O-ring is eliminated. To enhance the ability of the barrier wall to function as its own gasket, an alternative embodiment includes an O-ring like projection 107 on one side of the wall. Although not shown, a second O-ring like projection may be added to the opposite side to provide gasketing on either side of the barrier wall. The resiliency, compliance, and compressibility of the O-ring like projection, or of the barrier wall itself may be increased over that of the basic plastic used to form the wall by means of blind pores which do not pass through the wall. There is no added cost in producing the blind pores because they are produced at the same time and in the same manner as the pores in the filter area 106. Similarly, blind pores are also produced in the area 108 located directly on the opposite side of the barrier wall from the O-ring like projection to provide a compressible area abutting the bearing surface 110 on shoulder 113 in order to provide an improved seal between the barrier wall and the cap. The seal between the barrier and the container as well as the seal between the barrier and the cap reduce the amount of moisture entering the system from outside, thereby extending the life of the desiccant.

In the embodiment of FIG. 1, the periphery of the barrier includes threads 112 which engage the threads 111 located on the inside walls of the cavity 107. In the production process, described in more detail below, the desiccant and the humidity sensitive color indicator are first deposited in the closed end of the cavity and then the barrier wall is threaded into place against the bearing surface 110, sealing the desiccant and color indicator within the cavity. In the use of the desiccant cap, the container 105 is threaded into the cavity on the same threads 111, securing the cap to the container. In this process, the pressure applied by the container on the barrier wall is transmitted through the wall against the bearing surface 110, further improving the seal between the barrier wall and the cap.

Figure 3:
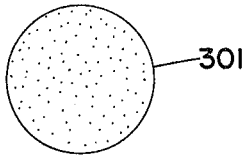
FIG. 3 is a top view of the filter and the barrier wall.
Figure 4A:
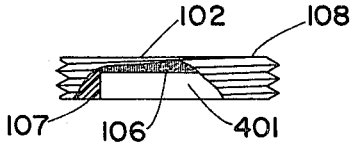
FIG. 4A is a side elevation view of a barrier wall and filter which includes threads at its periphery for securing the filter within the cap.

There are a number of embodiments of the barrier wall that function satisfactorily in the present invention, three of which are illustrated in FIGS. 3 and 4. FIG. 3 illustrates the basic filter and barrier wall 301 in plan view, while FIG. 4A illustrates a threaded type similar to that shown in FIG. 1. In the embodiment of FIG. 4A, the threads are used to secure the barrier wall in place against the bearing surface 110 as described above. The break away view of FIG. 4A also illustrates the O-ring like projection 107 and a raised area 401 within the O-ring projection containing the porous, centrally located filter area 106.

In one low cost production process for the present invention, the enclosures are formed automatically by standard injection or thermo-compression molding techniques. The cap cavity receives a measured deposit of desiccant and humidity sensitive color indicator. The barrier wall is then inserted and attached to the cavity walls to complete the fabrication of the cap. All of the fabrication and assembly steps are automated to drastically reduce cost over prior art processes where the individual components were generally separately machined and then individually assembled. The cost savings of these processes permits the caps to be used only once and then discarded, a decided advantage for pharmaceuticals, where repetitive use must be avoided to prevent contamination.

Figure 4B:
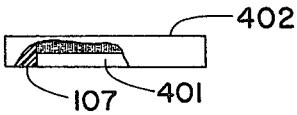
FIG. 4B is a side elevation view of a barrier wall and filter embodiment designed for direct insertion within a cap without threading.

In the above described low cost production process, barrier walls of the type shown in FIG. 4B (threadless type 402) or 4C (threadless and projectionless type 403) are used to avoid threading. These walls are simply dropped in position against the bearing surface and bonded in place by means of a chemical bonding agent such as epoxy cement or by fusing the barrier wall to the bearing surface by means such as RF heating.

Figure 5A:
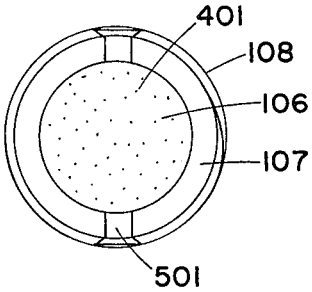
FIG. 5A is a bottom view of a barrier wall embodiment having slots in the peripheral projection for automatic insertion.
Figure 4C:
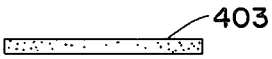
FIG. 4C is a side elevation view of a barrier wall design for direct bonding to the enclosure and for use with an external gasket.

Although the threaded embodiment of FIG. 4A is not as readily adaptable to high volume production as the embodiment shown in FIGS. 4B and 4C, it may be adapted for medium to high volume production through the use of special tooling in conjunction with a slot 501 in the projection 107 as shown in FIG. 5A. In low volume production, this slot is driven by conventional tools to thread the barrier wall into the enclosure cavity. In high volume production, this slot is used to pick up, position and drive the wall into position by a special tool shown in FIGS. 5C and 5D.

Figure 5B:
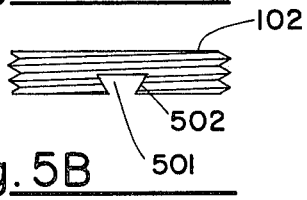
FIG. 5B is a side elevation view of the barrier wall of FIG. 5A showing a taper in the slot side walls.

The cross section of the slot is shown in FIG. 5B to have tapered sided walls 502 which are positioned to widen the slot with depth. This configuration of the slot permits either conventional tools or special tools to thread the barrier wall into position.

Figure 5D:
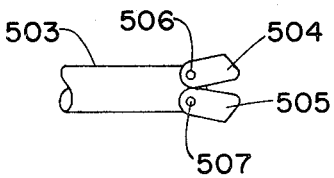
FIG. 5D is a side elevation view of the tool shown in FIG. 5C with the pawls positioned for insertion.
Figure 5C:
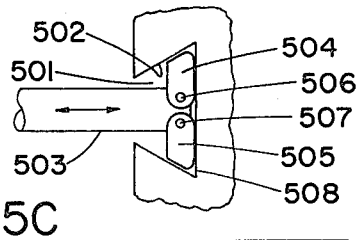
FIG. 5C is an enlarged view of the slot shown in FIG. 5B with an automatic tool positioned within the slot.

One type of special tool, shown in FIG. 5C, comprises a drive shaft 503, a first and a second pawl 504 and 505 pivoting respectively about detent pins 506 and 507, which pass through shaft 503.

In the operation of this special tool, the pawls are first positioned close together as shown in FIG. 5D. The pawls are held in this position by a second set of detents, not shown. The tool tip is first placed in position in the slot, where the tips of the pawls contact the bottom of the slot and then the pawls are driven outward into the position shown in FIG. 5C, where they are held by a second set of detents, not shown. In the position of FIG. 5C, the pawls may be used to aid in picking up the barrier wall and thread it into place in the enclosure cavity. Where no threads are used, the slot design remains useful in picking up and placing the barrier wall in the cavity. The pawls revert to the position shown in FIG. 5D when withdrawn from the slot.

An alternative tool configuration, not shown, contains conforming wedge shaped tips which are slideably positioned into the slots from the side, as for example from the region over the filter area 106, shown in FIG. 5A.

Having described our invention, we claim:

1. A desiccant cap for a container, comprising:

(a) a transparent, substantially nonporous plastic enclosure means having a generally cylindrical cavity with a closed end, the cavity being formed about a reference axis of revolution, and the cavity being partially threaded internally begining about its open end to accept and seal an opening in the container having mating external threads, the threads within the cavity extending into the cavity, but terminating before reaching the closed end of the cavity, (b) a mixture of desiccant and a humidity sensitive color indicator placed within the cavity adjacent the closed end beyond the termination of the threads, the color indicator being visible through the enclosure walls to indicate the humidity level within the cavity and container, (c) a shoulder extending inwardly of and completely about the periphery of the cavity wall adjacent the termination of the threads, the shoulder providing a bearing surface positioned adjacent the termination of the threads, generally orthogonal to the reference axis of revolution, and facing the open end of the cavity, and (d) a generally disc shaped barrier means with a diameter generally equal to that of the cavity, the barrier means formed of a wicking polymer and having a central area filter containing fine through pores, the barrier means being positioned within the cavity abutting and sealed to the bearing surface of the shoulder to separate the mixture of desiccant and humidity sensitive color indicator from the container and its contents, while permitting water vapor from the container to pass through the pores to maintain a dry atmosphere within the container and actuate the color indicator to indicate the level of humidity absorbed from the container, the extraction of water vapor from the container through the pores being aided by the characteristic of the wicking polymer.

2. Apparatus as claimed in claim 1, wherein the barrier means further comprises:

(a) threads about the periphery of the barrier means to mate with the threads within the cavity, (b) slot means, located on one side of the barrier means, the slot means having two side walls spaced apart for accepting a tool between the walls to drive the barrier means on the threads in the cavity, the pressure developed in threading the barrier means against the shoulder providing a seal between the barrier means and the shoulder.

3. Apparatus as claimed in claim 2, wherein the slot means includes a taper in the side walls of the slot which widens the slot with depth to accept tools that enable pick up and threading of the barrier wall.

4. Apparatus as claimed in claim 1, wherein the barrier means includes a projection on one side adjacent to and extending about the entire periphery of the barrier means, the projection including blind pores to provide a more compliant area than the unpored area of the barrier means to aid in sealing the container within the cavity.

5. Apparatus as claimed in claims 1 or 4, wherein the barrier means includes in the area abutting the shoulder, a plurality of blind pores to provide a more compliant area than the unpored area of the barrier means to aid in sealing the barrier means to the shoulder.

* * * * *